US011131035B2

(12) United States Patent
Andexlinger et al.

(10) Patent No.: US 11,131,035 B2
(45) Date of Patent: Sep. 28, 2021

(54) METAL PLATE

(71) Applicant: MÜNZE ÖSTERREICH AG, Vienna (AT)

(72) Inventors: Helmut Andexlinger, Vienna (AT); Paul Fennes, Steinberg (AT); Alfred Gnadenberger, Ober-Grafendorf (AT); Robert Grill, Lechaschau (AT); Herbert Wähner, Pitten (AT); Heinz Waldhäusl, Karl (AT)

(73) Assignee: Münze Österreich AG, Vienna (AT)

( * ) Notice: Subject to any disclaimer, the term of this patent is extended or adjusted under 35 U.S.C. 154(b) by 7 days.

(21) Appl. No.: 15/912,023

(22) Filed: Mar. 5, 2018

(65) Prior Publication Data

US 2018/0195195 A1 Jul. 12, 2018

Related U.S. Application Data

(62) Division of application No. 14/900,900, filed as application No. PCT/AT2014/000131 on Jun. 25, 2014, now abandoned.

(30) Foreign Application Priority Data

Jul. 5, 2013 (AT) ..... A 565/2013

(51) Int. Cl.

| | |
|---|---|
| ***C25D 11/02*** | (2006.01) |
| ***C25D 11/26*** | (2006.01) |
| ***A44C 21/00*** | (2006.01) |

(52) U.S. Cl.

CPC ..... *C25D 11/022* (2013.01); *A44C 21/00* (2013.01); *C25D 11/26* (2013.01)

(58) Field of Classification Search

CPC ..... C25D 11/022; C25D 11/16; A44C 121/00; G07F 1/06

See application file for complete search history.

(56) References Cited

U.S. PATENT DOCUMENTS 1,655,483 A * 1/1928 Wheeler ..... G09F 3/00 40/200
1,655,484 A * 1/1928 Wheeler ..... G09F 3/00 29/421.1
2,691,627 A 10/1954 Johnson
(Continued)

FOREIGN PATENT DOCUMENTS

DE 0280 886 A1 9/1988
DE 0 303 400 A2 2/1989
(Continued)

OTHER PUBLICATIONS

Definition of mint via Merriam-Webber (Year: 2020).*

*Primary Examiner* — Louis J Rufo
(74) *Attorney, Agent, or Firm* — Henry M. Feiereisen LLC

(57) ABSTRACT

The invention relates to a metal plate (1) for a coin (2), for a centre pill (3) of a coin (2) or for a ring (4) of a coin (2), where it is suggested that at least one subregion of a surface, on at least one side of the metal plate (1), has a dual-coloured optical element (5) and that said optical element (5) has at least one first region (6) with a first oxide layer (7) of one first colour which is an interference colour, and at least one second region (8) with a second colour, the first colour being different from the second colour.

15 Claims, 3 Drawing Sheets

(56) References Cited

U.S. PATENT DOCUMENTS

| | | | | | |
|---|---|---|---|---|---|
| 3,284,321 | A * | 11/1966 | Fromson | C25D 11/022 | 205/50 |
| 3,384,562 | A * | 5/1968 | Michelson | C25D 11/14 | 205/331 |
| 4,211,619 | A * | 7/1980 | Usbeck | B41N 3/034 | 101/459 |
| 4,267,218 | A * | 5/1981 | Brugger | F24S 70/60 | 428/34.1 |
| 4,375,391 | A * | 3/1983 | Kushida | C25D 11/04 | 205/121 |
| 4,421,612 | A * | 12/1983 | Videm | C23C 22/66 | 205/83 |
| 4,869,789 | A | 9/1989 | Kurze | | |
| 4,994,314 | A | 2/1991 | Rosenfeld | | |
| 5,178,967 | A | 1/1993 | Rosenfeld | | |
| 5,904,989 | A | 5/1999 | Hanggi | | |
| 9,487,058 | B2 | 11/2016 | Santini | | |
| 2004/0070129 | A1 | 4/2004 | Budde | | |
| 2005/0123745 | A1 | 6/2005 | Takahashi | | |
| 2011/0017602 | A1 | 1/2011 | Khosla | | |
| 2011/0247940 | A1* | 10/2011 | Huang | C25D 11/12 | 205/120 |
| 2013/0153429 | A1 | 6/2013 | Khosla | | |
| 2013/0187015 | A1 | 7/2013 | Quintana Rio | | |
| 2014/0131208 | A1* | 5/2014 | Chien | C25D 11/022 | 205/50 |
| 2014/0346049 | A1 | 11/2014 | Khosla | | |

FOREIGN PATENT DOCUMENTS

| | | | |
|---|---|---|---|
| DE | 0 802 267 | A1 | 10/1997 |
| DE | 10 2010 011185 | A1 | 9/2011 |
| FR | 2996199 | | 10/2017 |
| JP | H04327878 | A | 11/1992 |
| JP | H04369793 | A | 12/1992 |
| JP | H05222584 | A | 8/1993 |
| JP | 30-48232 | | 2/1998 |
| JP | 2007254851 | A | 10/2007 |
| JP | 2009-261889 | | 11/2009 |
| JP | 2013-198626 | | 10/2013 |
| WO | WO 91/19649 | | 12/1991 |
| WO | WO 2011/066594 | A1 | 6/2011 |

* cited by examiner

METAL PLATE

CROSS-REFERENCES TO RELATED APPLICATIONS

This application is a division of prior filed copending U.S. application Ser. No. 14/900,900, filed Dec. 22, 2015, the priority of which is hereby claimed under 35 U.S.C. § 120, and which is the U.S. National Stage of International Application No. PCT/AT2014/000131, filed Jun. 25, 2014, which designated the United States and has been published as International Publication No. WO 2015/000003 and which claims the priority of Austrian Patent Application, Serial No. A 565/2013, filed Jul. 5, 2013, pursuant to 35 U.S.C. 119(a)-(d), the disclosures of which are incorporated herein by reference in its entirety as if fully set forth herein.

BACKGROUND OF THE INVENTION

The invention relates to a metal plate.

Such a metal plate is provided for a coin, for a part of a coin such as a centre pill or a ring. Coins are not only used as coins intended for circulation, but are also used as collector coins and/or medallions. A medallion is a medal for example which is given as an award for special achievements of a sporting nature for example. Coins, especially collector coins or medallions, also need to meet high aesthetic requirements. For example, the award of medals during sports events is an important media event, wherein the medals often represent an important identification object of such events. Collector coins, which are arranged behind a showcase for example, shall also meet the required aesthetic demands. The appearance of a coin is frequently formed by the mintage, i.e. a three-dimensional relief.

It is disadvantageous that when coins are seen from a distance they rarely meet the aesthetic requirements, or offer a low degree of distinctiveness from the distance because the characteristic mintage can only be recognised well from close up.

It is therefore the object of the invention to provide a metal plate of the kind mentioned above with which the aforementioned disadvantages can be avoided, with which the aesthetic requirements are still ensured even from a greater distance, and which are simultaneously durable and can be produced at low cost.

This is achieved in accordance with the invention by a metal plate for a coin, for a centre pill of a coin or for a ring of a coin, wherein at least one subregion of a surface, on at least one side of the metal plate includes a dual-coloured optical element, the optical element having at least one first region with a first oxide layer with a first colour, which first colour is an interference colour, and at least one second region with a second colour, wherein the first colour is different from the second colour.

This leads to the advantage that the coins can also be differentiated and/or identified very well by the spectator even from a distance, because good contrast can be achieved by the dual-coloured optical element. Consequently, medals of a sports event will not lose anything with regard to their identification-promoting nature even in the case of TV transmission. The desired optical effect is also provided in the case of collector coins and/or medallions even from a distance, which is why it is sufficient to observe said coins in a closed showcase, as a result of which the removal from the showcase is no longer necessary, which would cause wear and tear to or soiling of the coin. Furthermore, a large number of further sophisticated coin designs are possible by the dual-coloured optical element, which designs were previously not possible. The oxide layer offers the advantage that its interference colour substantially has the same gloss as a polished metal surface, and is not more matte or darker than a pigment colour or a lacquering, and thus fulfils the highest aesthetic requirements. Furthermore, oxides are chemically more inert than metals, as a result of which the coin does not change its outer appearance even after many years because no further undesirable oxidation occurs.

The invention further relates to a method for producing a dual-coloured optical element of a metal plate.

It is the object of this method to produce a dual-coloured optical element as described above in an especially simple and reliable manner.

As a result, coins can be produced with an advantageous dual-coloured optical element, with little additional effort in comparison with conventional coins.

The dependent claims relate to further advantageous embodiments of the invention.

Express reference is hereby made to the wording of the claims, as a result of which the claims are inserted at this point into the description by way of reference and shall apply as being literally reproduced.

BRIEF DESCRIPTION OF THE DRAWING

The invention will be explained below in closer detail by reference to the enclosed drawings which merely show preferred embodiments by way of example, wherein.

DETAILED DESCRIPTION OF PREFERRED EMBODIMENTS

Figure 1:
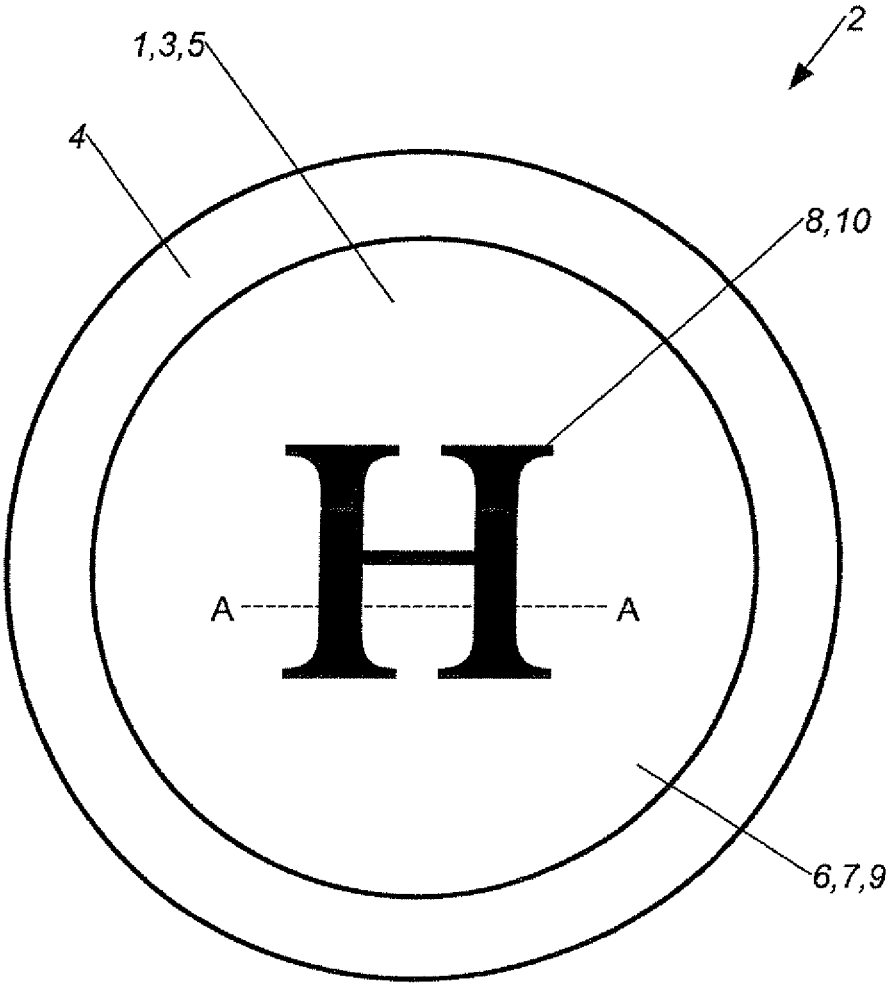
FIG. 1 shows a top view of a preferred embodiment of a coin with a metal plate formed as a centre pill.

FIGS. 1 to 6 show preferred embodiments of a metal plate 1 for a coin 2, for a centre centre pill 3 of a coin 2, or for a ring 4 of a coin 2, wherein at least one subregion of a surface on at least one side of the metal plate 1 comprises a dual-coloured optical element 5. The metal plate 1 can especially preferably be arranged in an integral manner and/or homogeneously. Homogeneous shall mean in this connection that the metal plate 1 substantially has the same chemical composition over the entire volume, in other words it does not concern a bimetal plate. A coin 2 can be arranged integrally or in several parts, especially in two parts. The inner portion of the coin 2 is designated as the centre pill 3 of a coin 2 in a two-part coin 2, e.g. a one euro coin. The ring 4 of a coin 2 is preferably the part of a two-part coin 2 which preferably surrounds the centre pill 3 at the edge. The metal plate can be formed in an angular or round manner, especially circular. A coin 2, or a portion of a coin 2, consisting of the metal plate 1 can be formed in an especially preferred way as a collector coin and/or medallion, especially as a medal. The subregion of the surface on at least one side of the metal plate 1 will be designated below merely as the subregion. The dual-coloured optical element 5 is arranged on at least one side of the metal plate 1. It can also be provided that a further dual-coloured optical element 5 is arranged on the opposite side. The dual-coloured optical element 5 can also comprise more than two colours and shall only be referred to below as the optical element 5.

The optical element 5 comprises at least one first region 6 with a first oxide layer 7 with a first colour, which first colour is an interference colour. The first oxide layer 7 is at least partly transparent in an especially preferred way. An interference colour is in this connection a colour which is produced when a light beam, especially white light, is reflected at least partly on both boundary surfaces of a layer of an at least partly transparent material, wherein a constructive and/or destructive interference of the individual colour components of the reflected light beam occurs by the difference of the optical path length. Ranges in the spectrum of the reflected light are therefore extinguished depending on the wavelength, through which the reflected light, as the interference colour, comprises the complementary colour of the extinguished spectral ranges. Since an interference colour depends on the angle of view, the direction of view can especially be determined for determining the first colour as normal to the viewed surface of the metal plate 1.

It can especially be provided that the first oxide layer 7 has a first thickness of 20 nm 2000 nm, especially 30 nm to 1000 nm, more preferably 50 nm to 500 nm. Interference colours can still be perceived well up to 2000 nm. Interference colours are particularly pronounced in the range of 50 nm to 500 nm.

It can be provided in an especially preferred way that the first thickness of the first oxide layer 7 is substantially constant over the entire surface area of the at least one first region 6.

It can further be provided in an especially preferred way that the first oxide layer 7 is formed as a metal oxide layer.

The optical element 5 further comprises at least one second region 8 with a second colour, wherein the first colour is different from the second colour. In this case, the first region 6 and the second region 8 can be parts of the subregion. It can especially be provided that the first region 6 is arranged to be directly adjacent to the second region 8. It can further be provided that the subregion is formed in a contiguous way.

The difference in the colour can be defined in an especially preferred way according to the LAB colour space, which is also known under the name CIELAB colour space. The LAB colour space comprises three dimensionless axes, namely the L axis which represents the brightness and can assume a value between 0 and 100, the a axis which represents the green or red component of a colour and can assume a value between −150 and 100, and the b axis which represents the blue or yellow component of a colour and can assume a value between −100 and 150. The LAB colour space allows displaying all colours that can be perceived by humans with different colour stimulus specifications, saturations and brightness levels as coordinate points, wherein the same Euclidean distances of two coordinate points correspond with respect to perception to the same colour distances by the selection of the axes.

It can be provided in an especially preferred way that the Euclidean distance of the first colour from the second colour in the dimensionless LAB colour space is at least 5, especially at least 10, more preferably at least 20, dimensionless units. In this case, the first colour represents a first coordinate point and the second colour a second coordinate point of the dimensionless LAB colour space.

The first region 6 and/or the second region 8 can be formed according to a predetermined motif for example. The selection of the motif illustrated here is entirely random and it is clear that the first region 6 and/or the second region 8 could represent any desired motif. The capital letter H is shown in FIG. 1 as the motif, wherein the H is shown as the second region 8 and the surrounding area as the first region 6. The first region 6 and/or the second region 8 can be formed as a contiguous area, as shown in FIG. 1, or from several sub-areas.

It can be provided in an especially preferred way that the first region 6 is formed as a depression 9 in relation to the second region 8. In other words, the optical element 5 can be provided with an elevation profile. The optical element 5 can especially be provided with a mintage, wherein—as shown in FIGS. 2 to 6—the first region 6 is formed as a depression and the second region 8 as an elevation 13. The optical element 5 can thus be produced in an especially simple way. Furthermore, the motif can be shown congruently both by the mintage and also by the optical element 5. The dimension is shown in FIGS. 2 to 6 in a highly distorted manner for improving understanding.

It can alternatively be provided that the second region 8 is formed as a depression 9 in relation to the first region 6.

It can especially be provided that the first region 6 is formed as a depression 9 by at least an elevation of 0.05 mm in relation to the second region 8. It can further be provided that the first region 6 and/or the second region 8 comprise a further mintage, which has a lower depth than 0.05 mm for example. Said further mintage can preferably represent fine details of the motif.

Numerous methods are known to the person skilled in the art for producing thin oxide layers.

The first oxide layer 7 can be produced for example by means of a physical vapour deposition method. Such physical vapour deposition methods, especially cathode sputtering, offer the advantage that a large number of possible oxides can be applied. As a result, the material of the first oxide layer 7 can be selected substantially independently of the material of the metal plate 1.

The first oxide layer 7 can also be produced as a further example by means of a chemical vapour deposition method. In this case too, many methods are known for producing even oxide layers.

The first oxide layer 7 can be produced alternatively by means of a thermal method, e.g. tempering. The metal plate 1 is heated in such a way that a first oxide layer 7 of a predetermined thickness is formed.

It can be provided in an especially preferred way that the first oxide layer 7 is produced electrochemically. An electrochemical coating method offers the advantage that it can be carried out with simple means and is easy to control.

It has proven to be especially advantageous in this case that the first oxide layer 7 is produced electrochemically by anodic oxidation. Anodic oxidation is also known under the name anodic dip coating, in short ATL. Anodic oxidation is often also known as anodising in the case of aluminium. An oxide layer produced by anodic oxidation advantageously has an especially constant layer thickness. Furthermore, anodic oxidation is easy to control, wherein the coating process is self-stopping at a specific thickness depending on the coating parameters. Self-stopping means in this connection that no further layer growth occurs from a specific layer thickness as a result of the high electrical resistance of the growing oxide layer, or only an irrelevant growth thereof. As a result, a final first thickness of the first oxide layer 7 can be predetermined very well by the different coating parameters. Furthermore, especially good mechanical meshing of the first oxide layer 7 with the remaining metal plate 1 is further provided in the case of anodic oxidation.

It can especially be provided that the first oxide layer 7 comprises an oxide of the material of the metal plate 1. As a result, the first oxide layer 7 is especially durable and shows especially high adhesive power on the metal plate 1.

It can be provided in an especially preferred manner that the metal plate 1 consists of a metal or a metal alloy of the group 4, 5 and/or 6 of the periodic system, especially Ti, Mo and/or Nb. It has been recognised that these metals or metal alloys are especially suitable for the optical element due to the properties of the metals or the associated metal oxides.

It can especially be provided that the metal plate 1 consists of Nb, i.e. niobium, because Nb has proven to be especially suitable.

The second region 8 can be formed in a different manner. It can be provided for example that the second region 8 is painted, lacquered and/or printed.

It can preferably be provided that the second region 8 is uncoated, i.e. no further colouring layer is artificially applied to the second region. In this case, the second region 8 substantially has the colour of the material of the metal plate 1. The second region 8 can also be regarded as non-coated when a natural oxide layer is formed by the reaction of the blank metal plate 1 with the ambient atmosphere, e.g. aluminium oxide on aluminium. An uncoated second region 8 is easy to produce and offers a good contrast to the first region 6 with its interference colour.

It can be provided in an especially preferred manner that the second region 8 has a second oxide layer 10 and the second colour is especially an interference colour. An optical element 5, which is aesthetically especially appealing from the distance, can thus be formed, wherein the second region is now also inert against external environmental influences.

The second oxide layer 10 can be produced like the first oxide layer 7 by different coating methods.

It can especially be provided that the second oxide layer 10 is produced electrochemically, especially by anodic oxidation. The anodic oxidation offers the additional effect that when the thickness of the first oxide layer 7 is already self-stopping there will be no further growth of the first thickness, as a result of which the production method is especially easy to control.

It can preferably be provided that the first oxide layer 7 and the second oxide layer 10 are produced with the same coating method and are especially formed substantially similar to the first oxide layer 7, apart from thickness.

It can especially be provided that the second oxide layer 10 has a second thickness of 20 nm to 2000 nm, especially 30 nm to 1000 nm, more preferably 50 nm to 500 nm.

It can be provided in an especially preferred manner that the second thickness of the second oxide layer 10 is substantially constant over the entire surface area of the at least one second region 8.

It can further be provided in an especially preferred manner that the first oxide layer 7 is thicker than the second oxide layer 10. Good contrast of the two interference colours of the first region 6 and the second region 8 can be achieved by the thicker first oxide layer 7. It can especially be provided in this case that the first oxide layer 7 is thicker than the second oxide layer 10 by 25 nm, especially 50 nm, more preferably 100 nm.

It can alternatively be provided that the first oxide layer 7 and the second oxide layer 10 substantially have the same thickness. The different colour of the first region 6 and the second region 8 can be provided in this case in such a way that the first region 6 and the second region 8 have a different surface roughness, through which differently perceivable interference colours of the first region 6 and the second region 8 can be achieved.

According to the preferred embodiment of a coin in FIG. 1, a coin 2 with a centre pill 3 and a ring 4 can be provided in an especially preferred manner, wherein at least the centre pill 3 as the metal plate 1 is formed as the aforementioned, advantageously formed metal plate 1 with an optical element 5. The ring 4 of the coin can be formed in an especially preferred manner from a different metal than the centre pill 3, especially silver. It is advantageous that the ring 4 protects the centre pill 3, and thus the optical element 5, from mechanical wear and tear.

The invention further comprises a method for producing the dual-coloured optical element 5 on at least one side of the metal plate 1, especially a coin 2, a centre pill 3 of a coin 2 or a ring 4 of a coin 2, comprising an oxide layer production step and a surface modification step.

In the oxide layer production step, an oxide layer 11 having an interference colour is produced at least on the one subregion of the surface of the metal plate 1.

Furthermore, the at least one second region 8 of the subregion is modified by means of an abrasive method in a surface modification step for achieving different optical properties of a first region 6 of the subregion of the surface. The different optical property can be formed as a different colour or different dullness for example.

As a result, a coin 2, a centre pill 3 of a coin 2 or a ring 4 of a coin 2 can thus be produced with an advantageous optical element 5 in an especially simple and reliable manner.

Although coating methods are known which only coat the first region 6 with an oxide layer 11 in a purposeful manner by means of a mask for example, it has proven to be advantageous and easier to coat an entire subregion of the surface of the metal plate 1 and to selectively change optical properties of the surface by means of an abrasive method separate from the oxide layer production step, wherein said surface modification step can occur before or after the oxide layer production step. Said surface modification step can include partial removal of the oxide layer 11, but can also merely relate to a modification of the surface for the oxide layer production step, e.g. in that the surface is roughened or polished in subregions, which thus allows changing the colour of the oxide layer 11 that is produced thereon.

It can preferably be provided that at least one subregion of the surface of the metal plate 1 is roughened prior to the surface modification step, especially pickled. The adhesive power of the oxide layer 11 can thus be improved, and an improved and more even perception of the oxide layer 11 can be achieved. Furthermore, a first region 6 and a second region 8 of the surface can further thus be produced by selective polishing and/or grinding of the roughened surface, which regions have different optical properties which in this case are gloss or dullness.

It can be provided for producing an optical element 5 that the surface modification step is carried out before the oxide layer production step. A first region 6 and the second region 8 can especially be produced with different optical properties by selective roughening, grinding or polishing of the subregion of the still metallic surface of the metal plate 1. As a result of the subsequent production of the oxide layer 11 on the subregion of the surface, the oxide layer 11 substantially has the same thickness, but the optical effect of the oxide layer 11 can be changed by the different structure of the underlying metal surface, through which the first region 6 and the second region 8 can be perceived with different colours. An especially simple method for producing an optical element 5 can thus be provided because the oxide layer production step can be formed as a final production step and a first region 6 having interference colour and a second region 8 with different colours can be provided by producing merely one oxide layer.

It can alternatively be provided in a preferred manner that the oxide layer production step is carried out before the surface modification step, and that in the surface modification step the oxide layer 11 is removed in the at least one second region 8 and is left in the at least one first region 6. An optical element 5 can thus also be produced in an especially simple way because an oxide layer ills applied at first to the at least one subregion of the surface and the oxide layer 11 is then merely selectively removed in the second region 8.

It can be provided in an especially preferred way that a height profile is minted into the at least one subregion of the surface of the metal plate 1 prior to the surface modification step. In this case, the first region 6 can especially be formed as a depression 9 and the second region 8 as an elevation 13. The height profile can thus determine the regions of the at least one subregion of the surface of the metal plate 1 where the abrasive method of the surface modification step will remove the surface.

The selective removal of the oxide layer 11 in the second region 8 can be simplified by the height profile for example. The minting of the height profile can be carried out before or after the oxide layer production step. It has proven to be advantageous if the height profile is minted on the metal plate before the oxide layer production step because the oxide layer 11 is thus not injured by the minting process.

It can further preferably be provided that after the removal of the oxide layer 11 in the second region 8 the metal plate 1 is minted again. This repeated minting can contain especially fine details.

If the surface modification step occurs before the oxide layer production step, the first region 6 and the second region 8 can be lifted from each other by the minting of the height profile in such a way that in the abrasive method of the surface modification step the second region 6 is modified and the first region 8 is not.

It can preferably be provided that a mechanical method, especially flat grinding and/or polishing, is selected as the abrasive method of the surface modification step. If the first region 6 is formed as a depression 9 and the second region 8 as an elevation 13, it can especially be provided that the at least one second region 8 is mechanically removed by grinding and/or polishing. This offers the major advantage that the shaping of the first region 6 and the second region 8 can occur by minting which is commonly used in a coin 2 anyway. No complex further method is thus required for shaping the first region 6 and the second region 8.

The selective removal of the second region 8 can also occur by other abrasive methods, e.g. by a laser, an ion and/or plasma jet, or by means of engraving. If the oxide layer production step has already occurred, the oxide layer 11 can also be removed by means of a lithographic method.

It can especially be provided that an oxide of the material of the metal plate 1 is produced as the oxide layer 11 of the oxide layer production step. The oxide layer 11 is thus especially durable and shows an especially high adhesive power on the metal plate 1.

It can preferably be provided that the oxide layer 11 of the oxide layer production step is produced by means of an electrochemical method, especially by oxidising the metal plate 1 by anodic oxidation. The oxide layer 11 can be produced in an especially simple way by an electrochemical method. It can be provided in an especially preferred manner that the oxide layer 11 is produced by oxidising the metal plate 1 by anodic oxidation. The advantages of anodic oxidation are, as already mentioned above, the constant layer thickness and the good controlling capability. The oxide layer 11 can also be produced alternatively by means of a physical vapour deposition method or by means of thermal tempering.

Figure 2:
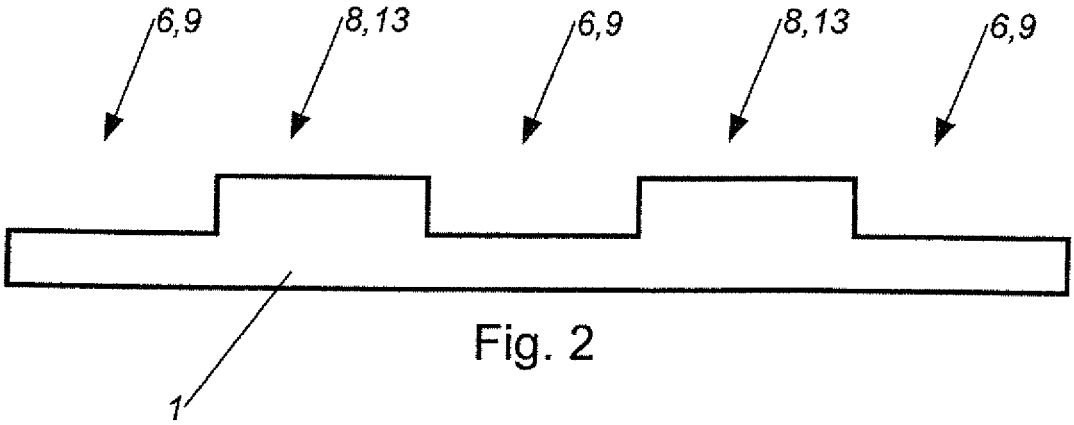
FIG. 2 shows the sectional view along the line A in FIG. 1 as a preferred first intermediate stage of a dual-coloured optical element.
Figure 3:
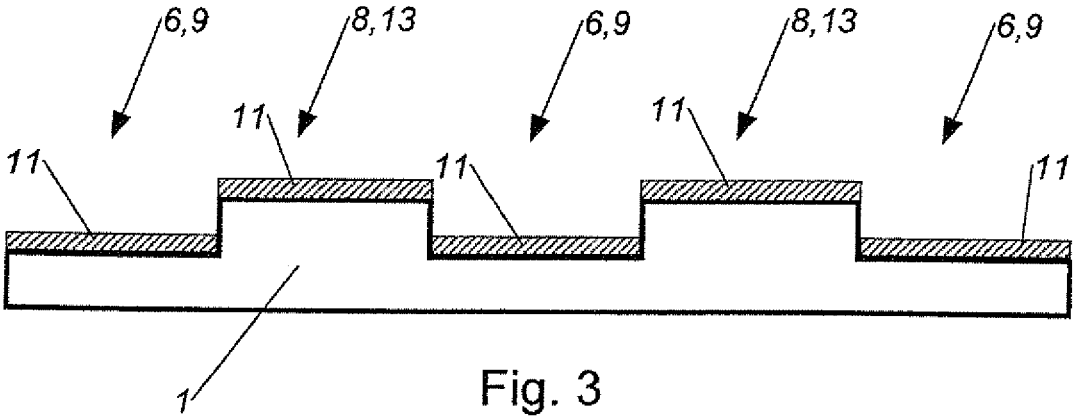
FIG. 3 shows the sectional view of FIG. 2 as a preferred second intermediate stage of a dual-coloured optical element.
Figure 4:
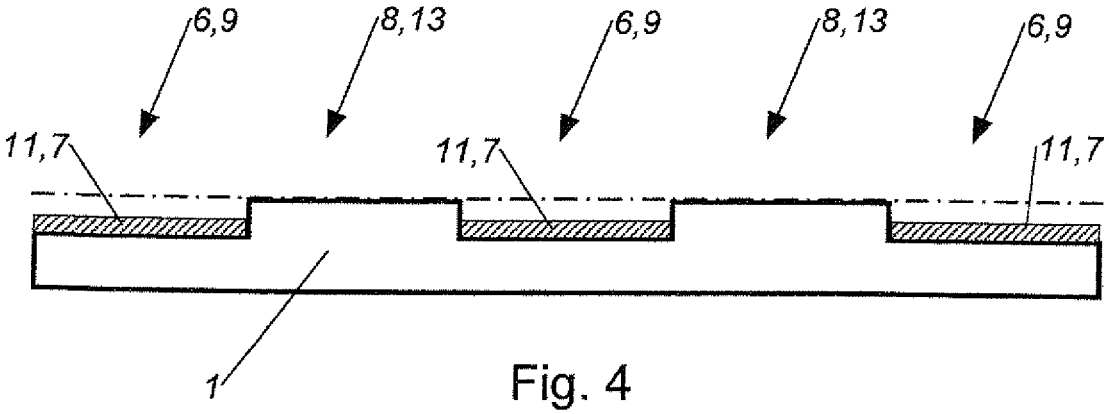
FIG. 4 shows the sectional view of FIG. 2 as a preferred first embodiment of a dual-coloured optical element.

Individual steps of a first preferred embodiment of such a method are shown in FIGS. 2 to 4.

FIG. 2 shows a part of the metal plate 1 which is provided with a height profile. In this case, a height profile was already minted on the metal plate 1. FIG. 3 shows the position of FIG. 2, wherein the metal plate was coated with the oxide layer 11 which evenly covers the first region 6 and the second region 8, i.e. the oxide layer production step has already occurred. In FIG. 4, the surface of the metal plate 1 was ground in a flat manner, as indicated by the dot-dash line, through which the oxide layer 11 was removed in the second region 8 and left unchanged in the first region 6.

FIG. 4 also represents a first preferred embodiment of the dual-coloured optical element 5. In this case, the oxide layer 11 left in the first region 6 represents the first oxide layer 7 of the optical element 5. The second region 8 is formed in an uncoated way.

It can preferably be provided, when the surface modification step occurred after the oxide layer production step, that after the surface modification step a further oxide layer 12 is produced on the at least one subregion of the surface of the metal plate 1. It can be provided in an especially preferred way that the further oxide layer 12 is produced with the same method as the oxide layer 11. As a result, an optical element can be provided with a first region 6 and a second region 8, wherein both regions 6, 8 have an interference colour.

It can further be provided in an especially preferred way that the further oxide layer 12 is produced in such a way that the first region 6 comprises a first oxide layer 7 with a first thickness and the second region 8 comprises a second oxide layer 10 with a second thickness, and the first thickness is greater than the second thickness. This leads to two different interference colours which can easily be distinguished from each other. As a result of the thicker first oxide layer 7, good contrast can be achieved between the two interference colours of the first region 6 and the second region 8.

It can especially be provided that the further oxide layer 12 represents the second oxide layer 10 in the second region 8.

Figure 5:
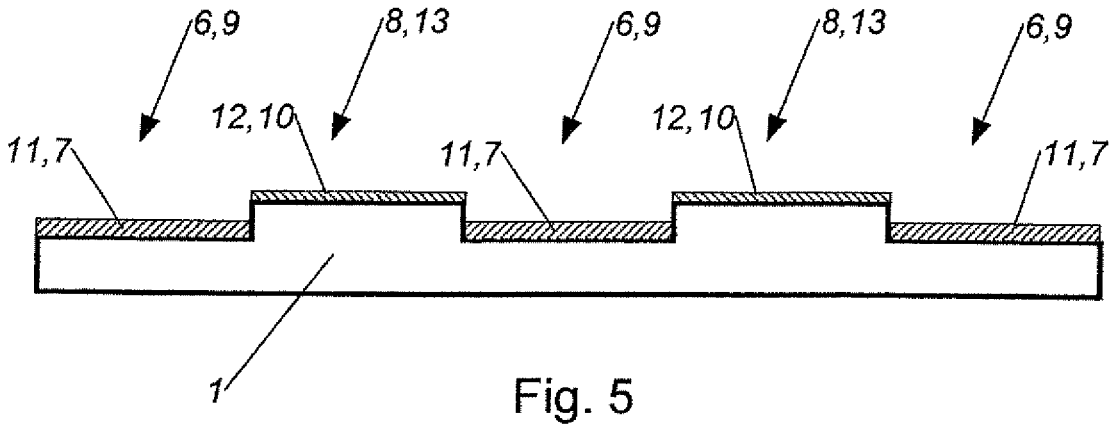
FIG. 5 shows the sectional view of FIG. 2 as a second preferred embodiment of a dual-coloured optical element.

FIG. 5 represents a second preferred embodiment of the dual-coloured optical element 5. In this case, the first oxide layer 7 has a self-stopping first thickness, and the further oxide layer 12 was produced by means of anodic oxidation, which is why no further layer growth substantially occurred in the first region 6. That is why the oxide layer 11 left in the first region 6 also represents the first oxide layer 7 of the optical element 5 in the second preferred embodiment. The further oxide layer 12 in the second region 8 represents the second oxide layer 10 of the optical element 5 in the second preferred embodiment.

Figure 6:
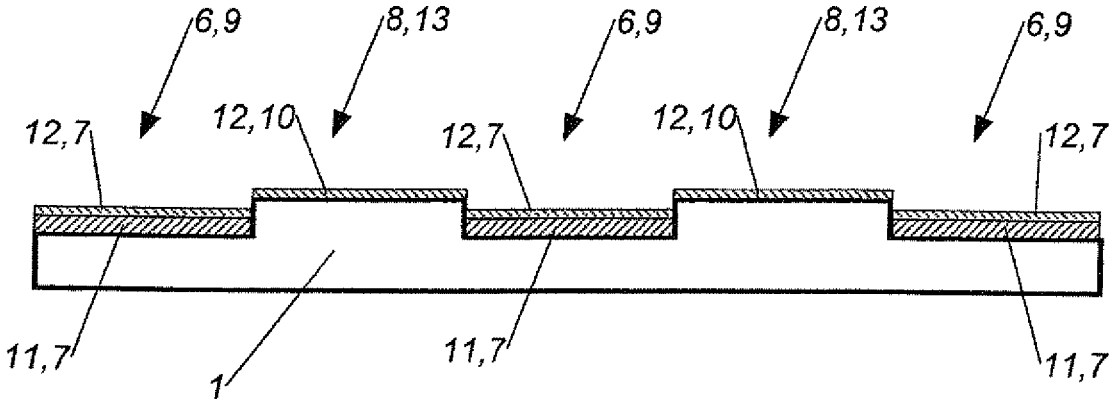
FIG. 6 shows the sectional view of FIG. 2 as a third preferred embodiment of a dual-coloured optical element.

In the third preferred embodiment in FIG. 6, a further layer growth occurred in the first region 6 in the coating process for producing the further oxide layer 12. This is the case when the further oxide layer 12 was produced by means of a physical vapour deposition method, where layer growth occurs irrespective of the base or because in the case of an anodic oxidation the first thickness was not yet self-stopping prior to the production of the further oxidation layer. The first oxidation layer 7 in the first region 6 therefore consists in the third preferred embodiment of the oxide layer 11 and the further oxide layer 12. The further oxide layer 12 in the second region 8 also represents the second oxide layer 10 of the optical element 5 in the third preferred embodiment.

It can preferably be provided according to a fourth preferred embodiment (not shown) that the at least one subregion of the surface of the metal plate 1 is minted and roughened, especially pickled. A height profile with a roughened surface is thus produced. The surface modification step is then carried out, wherein the second region 8 is ground and polished, whereupon the second region 8 is glossy but the first region is still matte. The oxide layer 11 on the at least one subregion of the surface is subsequently produced in the oxide layer production step, wherein different interference colours are produced by the different surface structure and the thus resulting optical properties of the first region 6 and the second region 8.

In order to produce an optical element 5 with more than two colours, it can be provided for example that a third region, which is especially a sub-region of the second region 8, is removed. An optical element 5 with three colours can thus be produced. An optical element 5 with any desired number of colours can also be produced by further coating with oxides and/or repeated removal in sections.

What is claimed is:

1. A method, comprising:

producing by an electrochemical process an oxide layer with an interference color on a subregion of a surface of a metal plate, wherein the metal plate comprises a metal or metal alloy selected from group four, group five, and/or group six of the periodic system;

embossing a height profile onto the subregion of the surface of the metal plate so as to leave the subregion in a contiguous way and form a first region of the subregion having a finite thickness as a depression of the height profile in relation to a raised second region of the subregion;

in a single surface modification step, grinding the surface of the metal plate in a flat manner across the entire subregion so as to remove the oxide layer completely in the raised second region of the subregion, while leaving the oxide layer unchanged in the first region of the subregion, for achieving a different optical property between the second region and the first region of the subregion of the surface; and producing a further oxide layer on the subregion to thereby produce a dual-colored optical element, with a motif being displayed in a congruent manner by both embossing of the height profile and by the optical element.

2. The method of claim 1, wherein the metal plate is a coin, a center pill of a coin, or a ring of a coin.

3. The method of claim 1, further comprising roughening prior to the surface modification step, at least the one subregion of the surface of the metal plate.

4. The method of claim 1, wherein the abrasive process is implemented by a mechanical process.

5. The method of claim 1, wherein an oxide of a material of the metal plate is produced as the oxide layer.

6. The method of claim 1, wherein the further oxide layer is produced in such a way that the first region has a first oxide layer with a first thickness, and the second region has a second oxide layer with a second thickness, with the first thickness being greater than the second thickness.

7. The method of claim 3, wherein roughening comprises pickling.

8. The method of claim 4, wherein the mechanical process comprises a flat grinding and/or polishing-off process.

9. The method of claim 1, wherein the electrochemical process comprises oxidizing the metal plate through anodic oxidation.

10. The method of claim 1, wherein the oxide layer is produced before embossing the height profile.

11. The method of claim 1, wherein the height profile is embossed before the oxide layer is produced.

12. The method of claim 1, wherein the metal or metal alloy is Ti.

13. The method of claim 1, wherein the metal or metal ahoy is Mo.

14. The method of claim 1, wherein the metal or metal alloy is Nb.

15. The method of claim 1, wherein the metal or metal alloy is Ti, Mo, and/or Nb.

* * * * *